US005755439A

United States Patent [19]

Turner

[11] Patent Number: 5,755,439

[45] Date of Patent: May 26, 1998

[54] DISK TOSS GAME

[76] Inventor: Rodney L. Turner, 3325 Briarwood, Horn Lake, Miss. 38637

[21] Appl. No.: 828,048

[22] Filed: Mar. 28, 1997

[51] Int. Cl.[6] ..... A63F 7/00

[52] U.S. Cl. ..... 273/126 R; 273/108; 273/400; 273/DIG. 26

[58] Field of Search ..... 273/126 R, 398, 273/400, 317, 348, 108, 118 R, DIG. 26

[56] References Cited

U.S. PATENT DOCUMENTS

| | | | |
|---|---|---|---|
| 203,189 | 4/1878 | Orth | 273/DIG. 26 |
| 2,520,460 | 8/1950 | Ford | 273/400 X |
| 3,386,737 | 6/1968 | Burgess | 273/126 R |
| 3,822,063 | 7/1974 | Rea | 273/410 X |
| 3,913,918 | 10/1975 | Trachtman | 273/126 R |
| 4,171,807 | 10/1979 | Lamlee | 273/DIG. 26 |
| 4,474,374 | 10/1984 | Lewis et al. | 273/126 R X |
| 5,029,863 | 7/1991 | Krawczyk et al. | 273/118 R X |
| 5,154,419 | 10/1992 | Madhavan | 273/126 R |
| 5,476,260 | 12/1995 | Otley | 273/118 R |

*Primary Examiner*—Raleigh W. Chiu

[57] ABSTRACT

A new Disk Toss Game for offering a game of skill playable indoors and outdoors that requires a player to toss a game disk into a target hole on a target board. The inventive device includes a target board with a multi-sided bank shot wall and a target hole at one end, and a plurality of game disks that are tossed by a player at the target board from a predetermined distance so that the game disks may land in the target hole. The end of the target board is semi-octagonal in shape. Since the bank shot wall projects upward from the target surface along the edges of the end of the target board, the bank shot wall is multi-sided and is also semi-octagonal in shape.

11 Claims, 3 Drawing Sheets

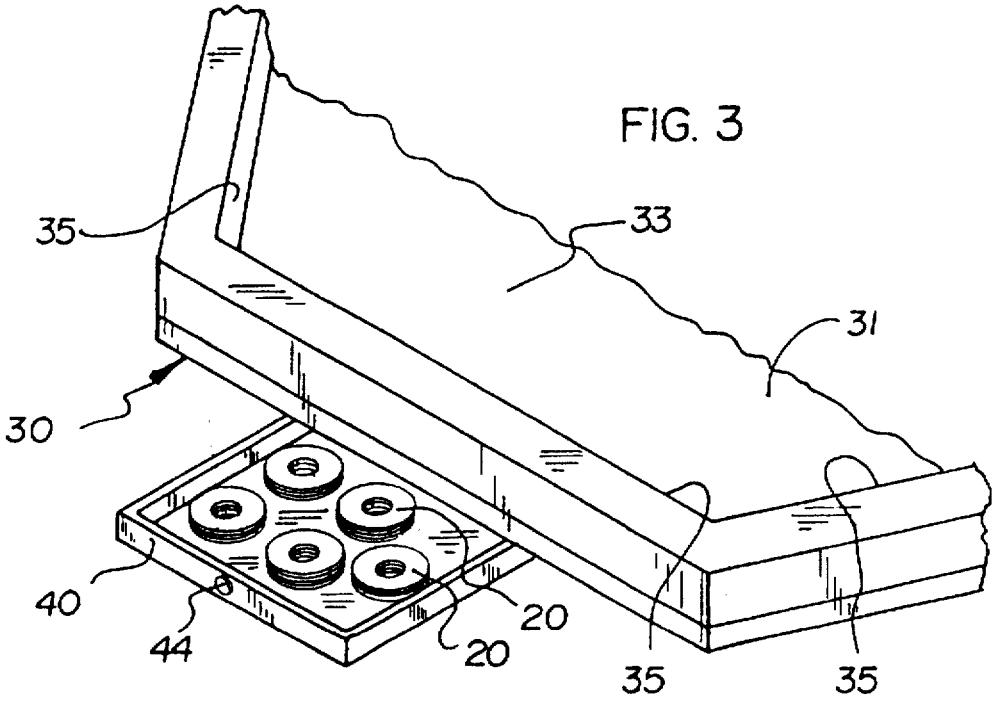
FIG. 3
FIG. 4
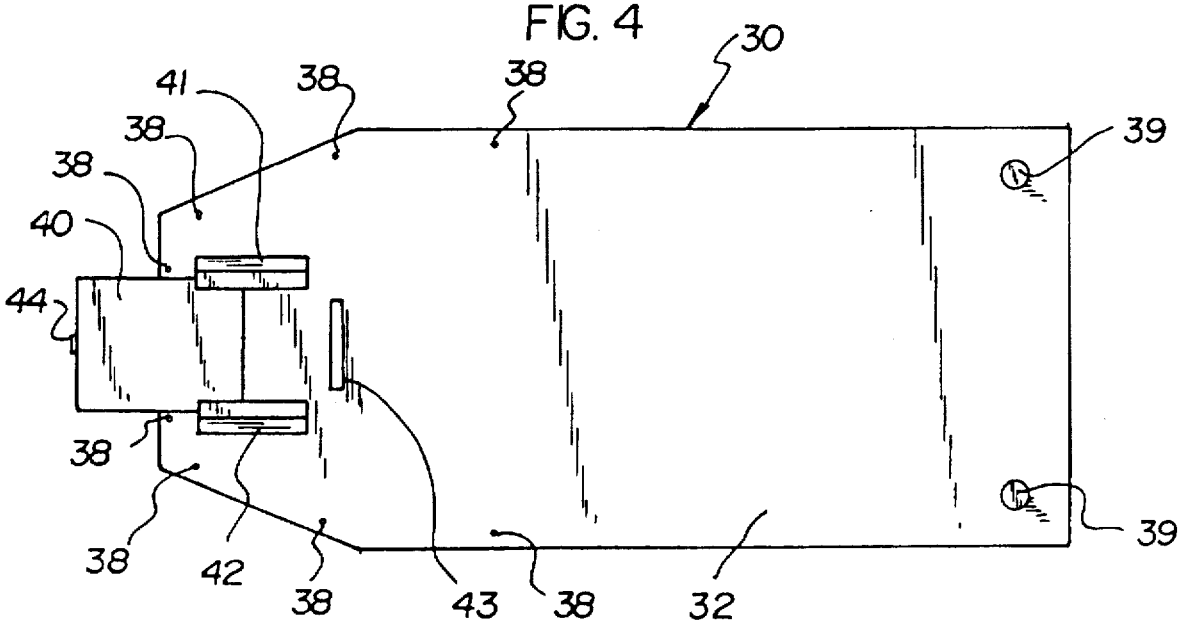

DISK TOSS GAME

BACKGROUND OF THE INVENTION

1. Field of the Invention

The present invention relates to object toss games and more particularly pertains to a new Disk Toss Game for offering a game of skill playable indoors and outdoors that requires a player to toss a game disk into a target hole on a target board.

2. Description of the Prior Art

The use of object toss games is known in the prior art. More specifically, object toss games heretofore devised and utilized are known to consist basically of familiar, expected and obvious structural configurations, notwithstanding the myriad of designs encompassed by the crowded prior art which have been developed for the fulfillment of countless objectives and requirements.

Known prior art object toss games include U.S. Pat. No. 5,067,727; U.S. Pat. No. 5,316,310; U.S. Pat. No. D288,828; U.S. Pat. No. 5,110,139; U.S. Pat. No. 4,180,266 and U.S. Pat. No. D301,899.

While these devices fulfill their respective, particular objectives and requirements, the aforementioned patents do not disclose a new Disk Toss Game. The inventive device includes a target board with a multi-sided bank shot wall and a target hole at one end, and a plurality of game disks that are tossed by a player at the target board so that the game disks may land in the target hole.

In these respects, the Disk Toss Game according to the present invention substantially departs from the conventional concepts and designs of the prior art, and in so doing provides an apparatus primarily developed for the purpose of offering a game of skill playable indoors and outdoors that requires a player to toss a game disk into a target hole on a target board.

SUMMARY OF THE INVENTION

In view of the foregoing disadvantages inherent in the known types of object toss games now present in the prior art, the present invention provides a new Disk Toss Game construction wherein the same can be utilized for offering a game of skill playable indoors and outdoors that requires a player to toss a game disk into a target hole on a target board.

The general purpose of the present invention, which will be described subsequently in greater detail, is to provide a new Disk Toss Game apparatus and method which has many of the advantages of the object toss games mentioned heretofore and many novel features that result in a new Disk Toss Game which is not anticipated, rendered obvious, suggested, or even implied by any of the prior art object toss games, either alone or in any combination thereof.

To attain this, the present invention generally comprises a target board with a multi-sided bank shot wall and a target hole at one end, and a plurality of game disks that are tossed by a player at the target board so that the game disks may land in the target hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Disk Toss Game apparatus and method which has many of the advantages of the object toss games mentioned heretofore and many novel features that result in a new Disk Toss Game which is not anticipated, rendered obvious, suggested, or even implied by any of the prior art object toss games, either alone or in any combination thereof.

It is another object of the present invention to provide a new Disk Toss Game which may be easily and efficiently manufactured and marketed.

It is a further object of the present invention to provide a new Disk Toss Game which is of a durable and reliable construction.

An even further object of the present invention is to provide a new Disk Toss Game which is susceptible of a low cost of manufacture with regard to both materials and labor, and which accordingly is then susceptible of low prices of sale to the consuming public, thereby making such Disk Toss Game economically available to the buying public.

Still yet another object of the present invention is to provide a new Disk Toss Game which provides in the apparatuses and methods of the prior art some of the advantages thereof, while simultaneously overcoming some of the disadvantages normally associated therewith.

Still another object of the present invention is to provide a new Disk Toss Game for offering a game of skill playable indoors and outdoors that requires a player to toss a game disk into a target hole on a target board.

Yet another object of the present invention is to provide a new Disk Toss Game which includes a target board with a multi-sided bank shot wall and a target hole at one end, and a plurality of game disks that are tossed by a player at the target board so that the game disks may land in the target hole.

Still yet another object of the present invention is to provide a new Disk Toss Game that improves motor skills and hand-eye coordination.

Even still another object of the present invention is to provide a new Disk Toss Game that encourages physical activity and group play.

Even still another object of the present invention is to provide a new Disk Toss Game that is portable and storable.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an illustration of the storage drawer for the game disks of the present invention.

FIG. 4 is a bottom view of the target board of the present invention.

DESCRIPTION OF THE PREFERRED EMBODIMENT

Figure 1:
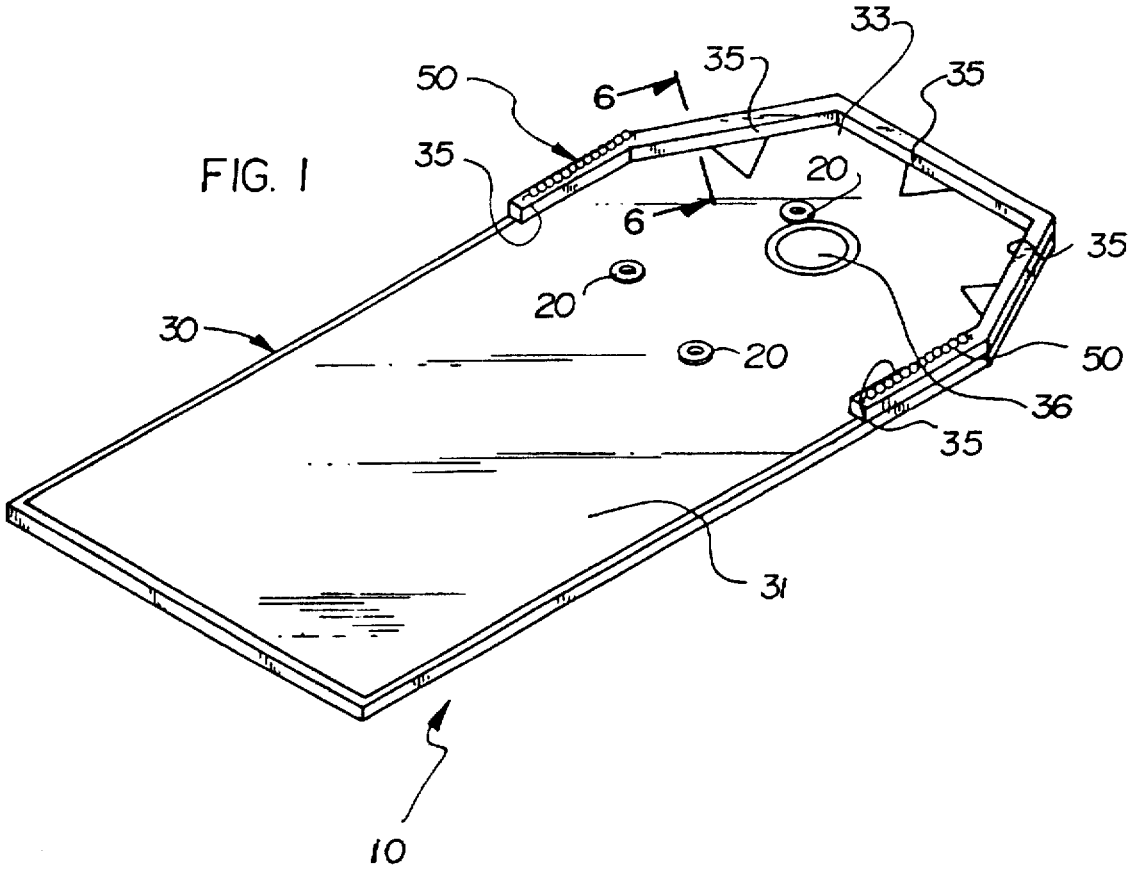
FIG. 1 is an isometric illustration of the target board of a new Disk Toss Game according to the present invention.

With reference now to the drawings, and in particular to FIGS. 1 through 6 thereof, a new Disk Toss Game embodying the principles and concepts of the present invention and generally designated by the reference numeral 10 will be described.

More specifically, it will be noted that the Disk Toss Game 10 comprises a target board 30 with a multi-sided bank shot wall 35 and a target hole 36 at one end, and a plurality of game disks 20 that are tossed by a player at the target board 30 so that the game disks 20 may land in the target hole 36.

The target board 30 has a target surface 31, a bottom surface 32, and a target end 33. The target hole 36 is provided in the lateral center of the target surface 31 at the target end 33 of the target board 30. The target surface 31 may be made of wood or plastic and measure 36 inches by 20 inches. The bank shot wall 35 projects upward from the target surface 31 along the edges of the target end 33 of the target board 30. The bank shot wall 35 may be made of a resilient material.

Figure 6:
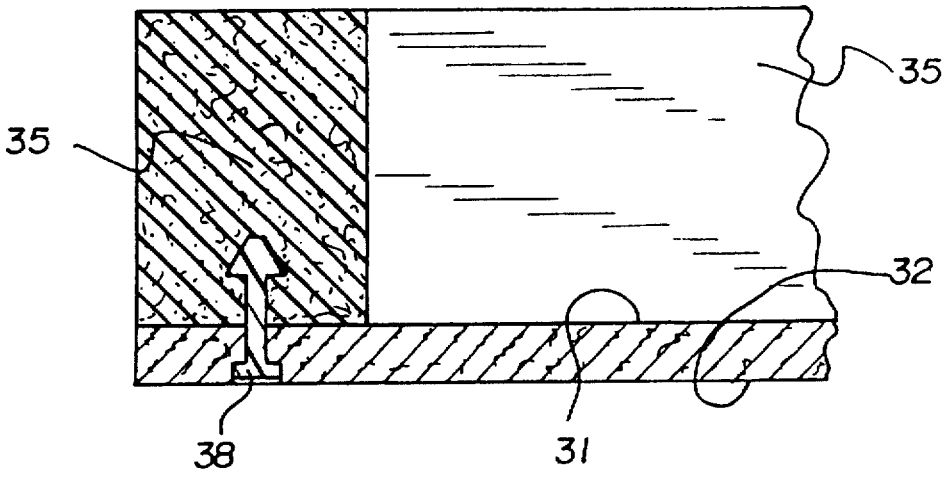
FIG. 6 is a cross sectional view taken along line 6—6 of FIG. 1.

As best illustrated in FIG. 1, it can be shown that the target end 33 of the target board 30 is semi-octagonal in shape. Since the bank shot wall 35 projects upward from the target surface 31 along the edges of the target end 33 of the target board 30, the bank shot wall 35 is multi-sided and is also semi-octagonal in shape. As best illustrated in FIG. 6, it can be shown that the bank shot wall 35 is attached to the target surface 31 of the target board 30 by a plurality of fasteners 38. As best illustrated in FIG. 4, it can be shown that feet 39 are provided on the bottom surface 32 of the target board 30 to level and elevate the target board 30.

Figure 2:
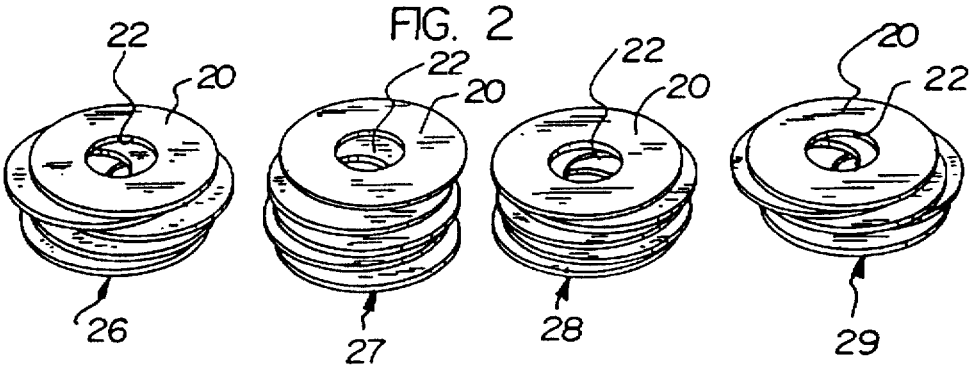
FIG. 2 is an illustration of the game disks of the present invention.

As best illustrated in FIG. 2, it can be shown that the game disks 20 are circular in shape and have a central aperture 22 therethrough. The game disks 20 typically have a diameter of one to three inches. Four sets of game disks 26, 27, 28, and 29 consisting of five game disks 20 each are provided. Each set of game disks 26, 27, 28, and 29 is uniquely colored.

The target board 30 includes a storage drawer 40 for storage of the game disks 20 when not in use. As best illustrated in FIGS. 3 and 4, it can be shown that the storage drawer 40 is slidingly mounted on the bottom surface 32 of the target board 30. Drawer guides 41 and 42 and drawer stop 43 guide and hold the storage drawer 40 in place on the bottom surface 32 of the target board 30. A drawer handle 44 is provided on the face of the storage drawer 40 to facilitate opening and closing of the storage drawer 40.

Figure 5:
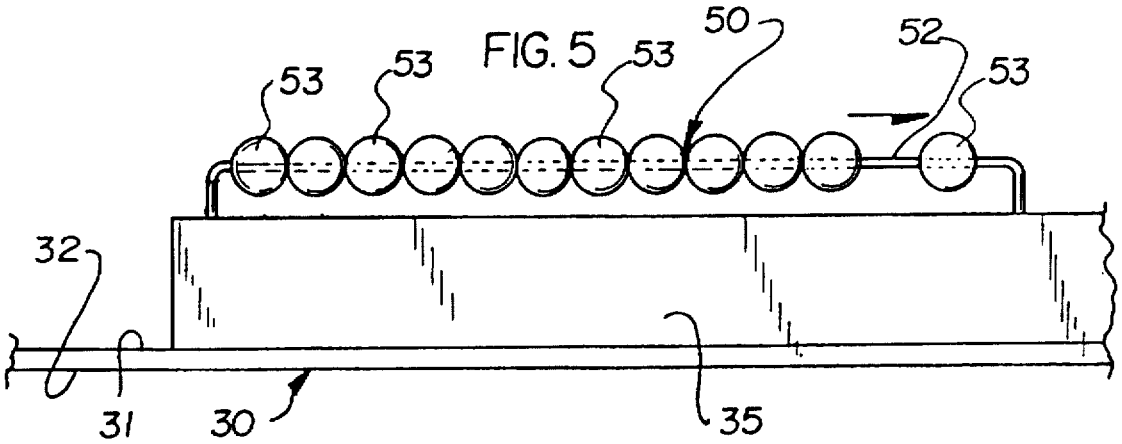
FIG. 5 is an illustration of the scoring means of the present invention.

The target board 30 also includes a scoring means 50 for keeping a record of points that a player earns. As best illustrated in FIG. 5, it can be shown that the scoring means 50 comprises a rod 52 and a plurality of beads 53 slidingly mounted and restrained on the rod 52. Each of the beads 53 has a bore 54 through the center thereof for receiving the rod 52. The rod 52 is mounted parallel to and attached at both ends to the target board 30.

In use, the target board 30 is placed at a predetermined distance from a player. A player tosses a game disk 20 at the target board 30 so that the game disk 20 may land in the target hole 36 and thus earn the player a score.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

APPENDIX

Typical Rules of the Game

1. Two to four players can play the game.
2. A score of ten points wins.
3. Each player receives five game disks. The game disks are uniquely colored so as to be distinguishable for each player.
4. To determine which player goes first, each player tosses a game disk. The player tossing a game disk closest to the target hole goes first.
5. A player scores one point for tossing a game disk into the target hole.
6. If a game disk lands close to the target hole, but not in the target hole, the player may knock the game disk into the target hole with a subsequent game disk and score one point.
7. If a player knocks an opponent's game disk into the target hole, the opponent scores one point.

8. The predetermined distance between the players and the target board is recommended as five feet for indoor game play and up to fifty feet for outdoor game play.

Advanced Rules of the Game

1. A player may eliminate a point scored by an opponent by tossing a game disk into the target hole immediately following the opponent's score.

2. A player may only score by banking a game disk off the bank shot wall and into the target hole.

What is claimed as being new and desired to be protected by LETTERS PATENT of the United States is as follows:

1. A disk toss game comprising:

a substantially planar target board placed at a predetermined distance from a player, said target board having a substantially planar target surface and a target end, said target board including a bank shot wall at said target end and a substantially circular target hole through said target surface at said target end, said bank shot wall projecting upward from said target surface along an edge of said target end of said target board; and a plurality of game disks that are tossed by said player at said target board so that said game disks may land in said target hole.

2. The disk toss game of claim 1, wherein said target hole is provided in a lateral center of said target surface at said target end of said target board.

3. The disk toss game of claim 1, wherein said target end of said target board is semi-octagonal in shape.

4. The disk toss game of claim 3, wherein said bank shot wall is semi-octagonal in shape.

5. The disk toss game of claim 1, wherein said target board has a bottom surface and further comprising feet provided on said bottom surface of said target board to level and elevate said target board.

6. The disk toss game of claim 1, wherein said game disks are circular in shape and have a central aperture therethrough.

7. The disk toss game of claim 1, further comprising a storage drawer for storage of said game disks when not in use, said storage drawer slidingly mounted on said bottom surface of said target board.

8. The disk toss game of claim 1, further comprising a scoring means provided on said target board for keeping a record of points that said player earns.

9. The disk toss game of claim 8, wherein said scoring means comprises:

a rod mounted parallel to and attached at both ends to said target board, and a plurality of beads slidingly mounted and restrained on said rod, each of said beads having a bore through a center thereof for receiving said rod.

10. A disk toss game comprising:

a target board placed at a predetermined distance from a player, said target board having a target surface and a target end, said target board including a bank shot wall at said target end and one substantially circular target hole extending downward through said target surface, said target hole positioned centrally in the target end of the target board, said bank shot wall projecting upward from said target surface along an edge of said target end of said target board, said edge of said target end being substantially semi-octagonal shaped;

a plurality of game disks that are tossed by said player at said target board so that said game disks may land in said target hole;

a pair of adjustable feet extending from a bottom surface of said target board;

a storage drawer positioned under said target surface, said drawer coupled to said bottom surface proximate said target end;

a pair of drawer guides positioned on opposite sides of said drawer such that drawer is extendable out from underneath said target board;

a drawer stop extending from said bottom surface such that said drawer abuts said drawer stop when said drawer is placed into a closed position; and a score keeping means for displaying current score values, said scoring means extending upwards from said bank shot wall.

11. The disk toss game of claim 10, wherein said scoring means comprises:

a rod mounted parallel to and attached at both ends to said target board, and a plurality of beads slidingly mounted and restrained on said rod, each of said beads having a bore through a center thereof for receiving said rod.

* * * * *